US006212700B1

(12) United States Patent
Giesler et al.

(10) Patent No.: US 6,212,700 B1
(45) Date of Patent: Apr. 10, 2001

(54) PORTABLE TOILET UNIT

(75) Inventors: Rolf-Dieter Giesler, Kreuztal; Manfred Lorek, Siegen, both of (DE)

(73) Assignee: Sealand Technology, Inc., Big Prairie, OH (US)

( * ) Notice: Subject to any disclaimer, the term of this patent is extended or adjusted under 35 U.S.C. 154(b) by 0 days.

(21) Appl. No.: 09/516,188

(22) Filed: Mar. 1, 2000

Related U.S. Application Data

(60) Provisional application No. 60/126,655, filed on Mar. 29, 1999.

(51) Int. Cl.[7] ..... E03D 11/00
(52) U.S. Cl. ..... 4/420; 4/438
(58) Field of Search ..... 4/420, 321, 431, 4/438, 441

(56) References Cited

U.S. PATENT DOCUMENTS 3,663,970 * 5/1972 Drouhard, Jr. et al. ..... 4/111
3,772,711 * 11/1973 Spector ..... 4/78
3,798,681 * 3/1974 Johansen ..... 4/85
4,222,130 * 9/1980 Roberts ..... 4/321
4,313,233 * 2/1982 Roberts ..... 4/321
4,785,483 * 11/1988 Wise ..... 4/321
5,592,700 * 1/1997 Genesse ..... 4/246.1
5,909,968 * 6/1999 Olin et al. ..... 4/431
5,956,780 * 9/1999 Tyler ..... 4/321
5,960,483 * 10/1999 Delzer et al. ..... 4/420

* cited by examiner

*Primary Examiner*—Gregory L. Huson
*Assistant Examiner*—Huyen Le
(74) *Attorney, Agent, or Firm*—Nixon & Vanderhye P.C.

(57) ABSTRACT

A lightweight toilet unit is provided particularly for use with vehicles such as boats, RVs, and trailers. The toilet unit includes a plastic toilet bowl having an interior surface, open top, and exterior surface, a plastic body positioned exteriorly of the toilet bowl exterior surface, and a plastic toilet seat for partially closing the open top of the toilet bowl. To enhance the longevity and effectiveness of the toilet bowl without significantly increasing the cost and weight of the toilet unit, a layer, coating, or thin walled insert liner made of a non-polymeric substantially poreless material that is not degraded by contact with excrement, light, or toilet bowl cleaning agents, is disposed interiorly of the plastic toilet bowl and is at least partially supported by the plastic toilet bowl and may comprise porcelain, glazed ceramic, glass, corrosion resistant sheet metal, or sheet metal with a corrosion resistant poreless interior coating. The toilet bowl may be rotatably supported by a socket which mounts a common valve actuator (e.g. pedal) for supplying flushing liquid to the interior of the insert liner and substantially simultaneously opening a spherical segment valve at the outlet at the bottom of the toilet bowl.

24 Claims, 4 Drawing Sheets

PORTABLE TOILET UNIT

CROSS REFERENCE TO RELATED APPLICATION

This application is based upon U.S. provisional application Ser. No. 60/126,655 filed Mar. 29, 1999, the disclosure of which is incorporated by reference herein.

BACKGROUND AND SUMMARY OF THE INVENTION

Toilets that are provided in vehicles, or used for camping purposes or are otherwise portable, are typically made primarily of plastic. Constructing such toilet units of plastic not only is relatively inexpensive and allows simple construction thereof, but also the use of plastic saves weight, which is important in any type of vehicle, or for portability in general. Therefore conventional portable and mobile toilet units include a plastic toilet bowl, a plastic body positioned exteriorly of the toilet bowl, and a plastic toilet seat.

The toilet environment is extremely harsh and plastic components—plastic toilet bowls in particular—have a tendency to degrade more quickly than desired as a result of attack by chemicals and light. While it is thus highly desirable to provide toilet bowls having improved characteristics, so as to extend the life thereof, that desirable goal cannot be achieved by compromising the cost and low weight criteria that are very important for portable and mobile toilets. For example it is not possible—in a manner consistent with low weight and low cost—to replace the plastic toilet bowl with a toilet bowl material, like porcelain, that has outstanding resistance to degradation but relatively high cost and weight.

According to the present invention, a portable or mobile toilet unit is provided which is able to achieve a significantly longer life for the toilet bowl, and increase the hygiene associated therewith, while at the same time only minimally increasing the weight and cost of the toilet unit. This is accomplished according to the present invention by providing a non-polymeric, substantially poreless, material that is substantially not degraded as a result of contact with excrement, light, and toilet bowl cleaning agents, disposed interiorly of the plastic toilet bowl and for contacting liquid and materials passing through the toilet bowl open top. The material has an outlet adjacent the bottom thereof for leading sewage away from the toilet bowl. In appropriate cases the material may be provided as a layer or coating of, for example, porcelain or glazed ceramic (each about 0.3125 inches thick, for example); glass; or corrosion resistant sheet metal, or sheet metal with a corrosion resistant substantially poreless interior coating, (e.g. each about 0.05 inches thick). In the preferred embodiment, however, the material comprises a thin-walled (that is having the minimum thickness necessary for structural integrity considering the material utilized) insert liner which is disposed within and is at least partially supported by (typically almost completely supported by) the interior of the plastic toilet bowl. Using such an insert liner, the plastic toilet bowl itself can be made thinner than in conventional toilet units since it primarily only provides a supporting function; and since the insert liner is at least partially supported by the plastic toilet bowl, it can be thinner than it otherwise would have to be to have the sufficient structural integrity if it served as the only toilet bowl structure.

The insert liner may be attached by adhesive directly to the toilet bowl interior surface, or may be attached thereto by mounting foam. The toilet unit also preferably comprises a liquid flush mechanism which flushes liquid (such as water, or a deodorant liquid as commonly used in conventional vehicle toilets) into and through the insert liner. The insert liner outlet is typically sealed by a lip seal to other components. The plastic body may include an annular plastic cover adjacent the toilet seat and an upper rim of the insert liner may be received by the annular plastic cover. The annular plastic cover may mount a plurality of nozzles for introducing flushing liquid into the toilet bowl, directed against the insert liner, and the plastic toilet bowl may have a substantially radially extending portion which supports the annular plastic cover.

The plastic body may be rotatably supported by a socket, which in turn is rotatable about a substantially vertical axis and is mounted below the toilet bowl and insert liner. Within the socket may be a funnel-shaped conduit, communicating with a connection which passes through a wall of the socket, to lead sewage away from the toilet bowl outlet, e.g. to a holding tank either integral with the toilet unit or—in the case of most vehicles—distinct from the toilet unit. The toilet unit according to the invention is particularly suitable for use with vacuum flush toilets, such as sold by Sealand Technology, Inc. of Big Prairie, Ohio, such as under the "VACU-FLUSH" trademark. A common foot pedal actuator may be provided for operating a valve to supply flushing liquid to the nozzles, and to substantially simultaneously open a spherical segment valve to allow sewage to pass out of the insert liner through the outlet.

It is the primary object of the present invention to provide a toilet unit having necessary lightweight and low cost characteristics, but having enhanced hygiene and longevity of the toilet bowl thereof. This and other objects of the invention will become clear from an inspection of the detailed description of the invention and from the appended claims.

DETAILED DESCRIPTION OF THE DRAWINGS

Figure 1:
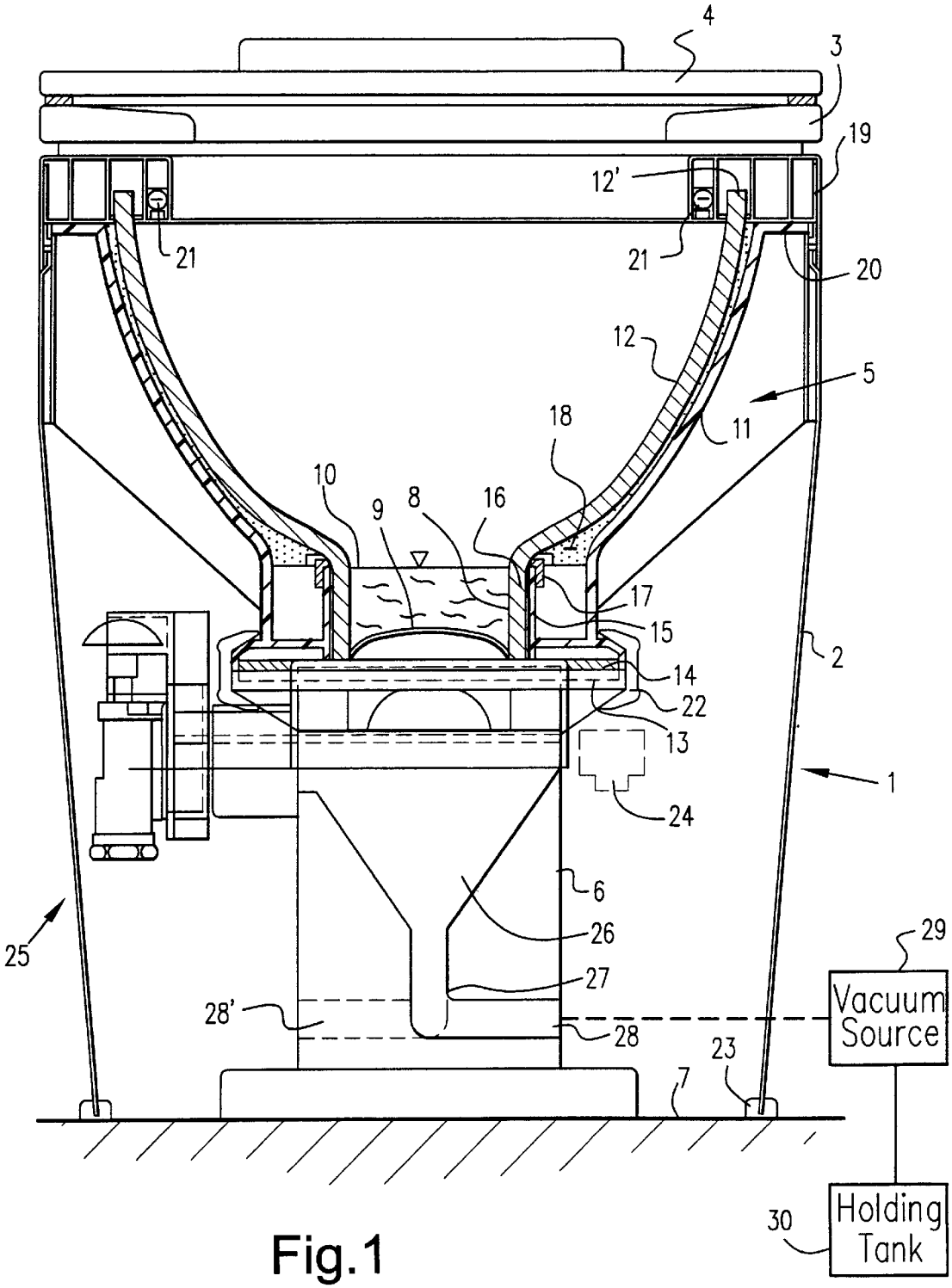
FIG. 1 is a side view, partly in elevation and partly in cross-section, of an exemplary portable or mobile toilet unit according to the present invention.

In the drawings the reference numerals refer to the following components:

1, 101 toilet unit
2 plastic basic body
3 plastic toilet seat
4 toilet seat cover
5 toilet bowl
6, 106 socket
7 support
8 outlet, exit
9, 109 spherical segment valve

Figure 2:
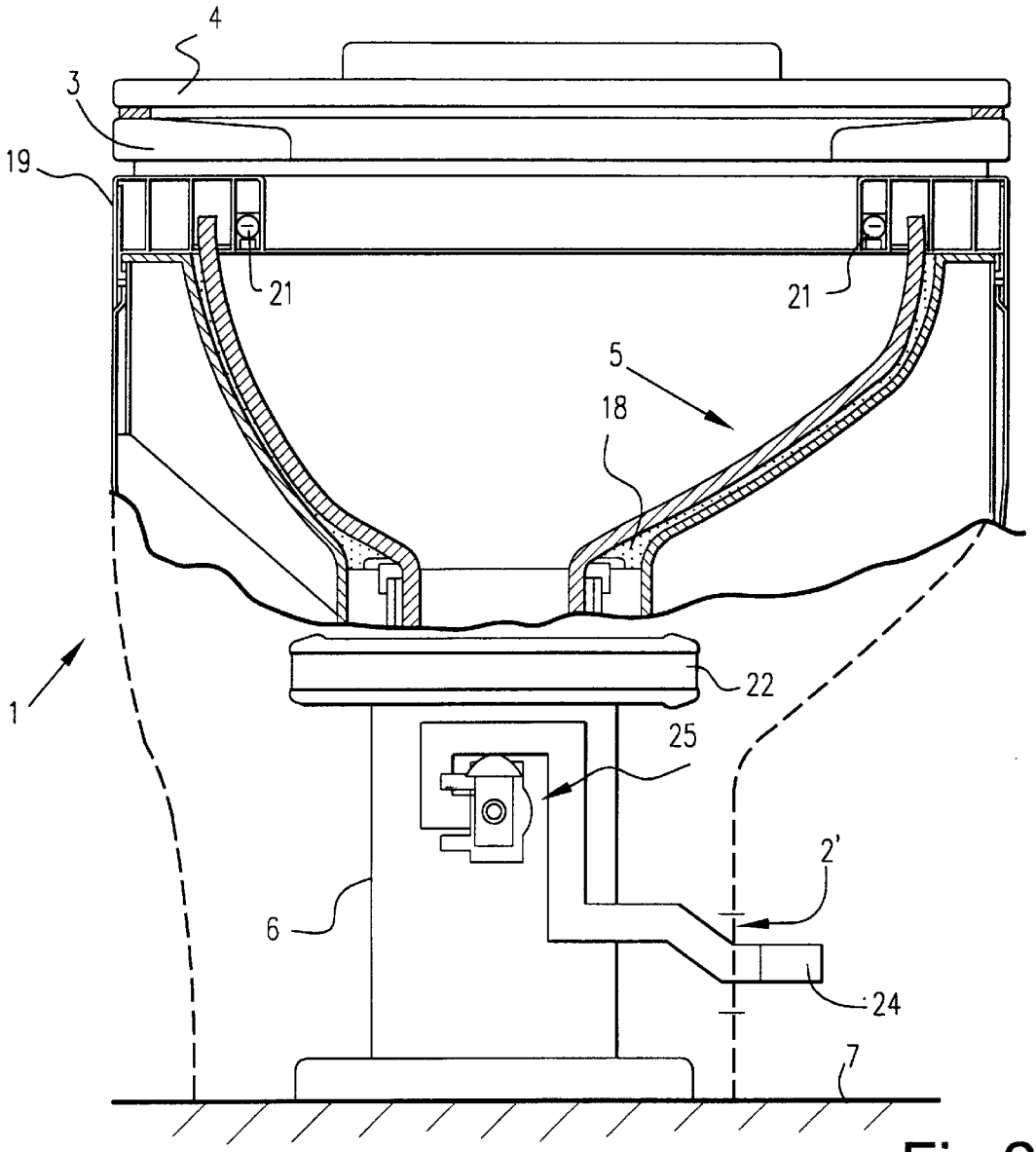
FIG. 2 is an end view, partly in cross-section and partly in elevation, and partly in outline, of the toilet unit of FIG. 1.

10 water level
11, 111 plastic toilet bowl
12, 112 insert liner for plastic toilet bowl
12' insert liner upper edge
13, 113 flange
14 seal
15, 115 cylinder section
16 insert liner bottom cylindrical section
17, 117 lip seal
18, 118 polyurethane mounting foam
19 annular plastic cover
20 radially extending upper edge
21 flush liquid introducing nozzles
22 locking mechanism
24, 124 pedal actuator
25, 125 flush valve unit
26, 126 funnel-shaped outlet
27 connecting piece
28, 28' connecting channel
29 vacuum source
30 holding tank
31 fresh water source
33 flange base for cylindrical section
34 bolts for holding flanges 113, 133 together
35 nuts for bolts 34
36 elastomeric seal for flanges 113, 133 and valve 109
37 pivot pins for valve 109
38 outlet opening in bottom of funnel 126
39 outlet conduit from toilet unit
40 discharge outlet opening from outlet conduit The toilet unit according to the present invention, in one exemplary form, is shown generally by reference numeral 1 in FIGS. 1 and 2. The basic generally conventional components include a plastic toilet bowl 11 having an interior surface, an open top, and an exterior surface, a plastic body 2 positioned exteriorly of the toilet bowl 11 exterior surface, a plastic toilet seat 3 for partially closing the open top of a plastic toilet bowl 11, and a plastic cover 4 for covering the toilet seat 3. While these components are conventional, the plastic toilet bowl 11 according to the present invention may be made thinner than in conventional constructions of portable or mobile toilet units.

According to the present invention in order to enhance the longevity and hygiene of the portable or mobile toilet unit 1, a non-polymeric, substantially poreless, material that is substantially not degraded as a result of contact with excrement, light, and toilet bowl cleaning agents, is disposed interiorly of the plastic toilet bowl 11 and for contacting liquid and materials passing through the toilet bowl 11 open top. The material may be in the form of a layer or coating on the plastic toilet bowl 11 interior surface if the plastic of the toilet bowl 11 and the non-polymeric material are compatible. However in the preferred embodiment illustrated in the drawings, the material comprises a thin-walled insert liner 12 which is disposed within and is at least partially supported by the interior surface of the plastic toilet bowl 11 (preferably all or the majority of the support for the insert liner 12 is provided by the plastic bowl 11). The insert liner 12 also defines the outlet 8 adjacent the bottom thereof for leading sewage away from the toilet bowl 5 (collectively the plastic toilet bowl 11 with the insert liner 12). Normally the outlet 8 is closed by a suitable valve 9, preferably a conventional spherical segment valve. A water level 10 is typically established within the bowl 5. Establishing the water level 10 so that it is substantially permanently maintained in the toilet bowl 5 indicates the tightness of the seal provided by the valve 9, and assists in providing an odor free environment.

The non-polymeric material, forming a layer, coating, or the preferred insert liner 12, may comprise or consist essentially of porcelain, glazed ceramic, glass, corrosion resistant sheet metal, or sheet metal with a corrosion resistant substantially poreless interior coating (e.g. enamel). The insert 12 is thin-walled, meaning that it has only the thickness necessary to provide sufficient structural integrity so that it does not crack or become easily damaged, considering that it is at least partially (if not substantially wholly) supported by the plastic toilet bowl 11. The thickness of the insert 12 will depend upon the particular material used therefor; for example if the insert liner 12 is of corrosion resistant sheet metal, such as aluminum or stainless steel, it will typically have a thinner wall than if of porcelain or glazed ceramic. A typical nominal thickness of a sheet metal liner 12 is about 0.05 inches, a typical nominal thickness of a vitreous china (or other porcelain or glazed ceramic) insert 12 is about 0.3125 inches, and a typical nominal thickness of the plastic toilet bowl 11 when the insert 12 is used is about 0.125 inches.

The insert 12 may be adhesively secured directly to the interior surface of the plastic toilet bowl 11, or it may be attached to the plastic toilet bowl 11 interior surface by mounting foam, such as the polyurethane mounting foam 18 illustrated in FIGS. 1 and 2. Polyurethane mounting foam 18 is preferred since when used the tolerances need not be as tight when manufacturing the toilet bowl 5 components 11, 12, and because the foam 18 provides improved breaking strength as well as noise dampening.

The plastic toilet seat 11 is supported at the bottom end thereof by a flange 13 of a socket 6. The flange 13 includes a seal 14 which comprises a cylindrical section 15 for receipt of a concentric cylindrical section 16 of the insert liner 12, and a lip seal 17 is also provided at the interface between the cylindrical section 15 and the concentric section 16 at the top of the cylindrical section 15. The socket 6 mounts the valve 9 for rotation about a substantially horizontal axis.

During manufacture of the toilet unit 1, the insert liner 12 is placed within the plastic toilet bowl 11, and then preferably the polyurethane mounting foam 18 is injected into a space between the bodies 11, 12—as illustrated in FIGS. 1 and 2—and allowed to cure. Where the tolerances are sufficient, the exterior surface of the insert liner 12 may be adhesively secured substantially directly to the interior surface of the plastic toilet bowl 11.

Preferably the plastic toilet bowl 11 includes a substantially radially extending upper edge 20 which provides a circumferential seat for an annular plastic cover 19, i.e. supports the substantially annular plastic cover 19. Cover 19 supplies vertical play for the plastic body 2. When a user sits on the toilet seat 3, a downward force is transmitted to the cover 19, which prevents the compression force from being transmitted to the insert liner 12 because the force is instead exerted on the plastic toilet bowl 11 and the plastic body 2 primarily via the substantially radially extending upper edge 20. The plastic cover 19 receives the upper edge 12' of the insert liner therein.

Preferably the toilet unit 1 has a liquid flush mechanism which flushes liquid into and through the insert liner 12. While any suitable conventional type of flush mechanism may be utilized, in the embodiment illustrated in the drawings the flush mechanism is provided by: a plurality of nozzles 21 mounted adjacent the bottom interior of the plastic cover 19, as seen in FIGS. 1 and 2, and for spraying liquid directly on to the insert liner 12 interior surface; and a conventional valve assembly 25 for selectively applying water, or other flushing liquid, from a flush liquid source (e.g. a toilet tank, or a separate tank, or the surrounding environment if on a boat) 31 (see FIG. 3). The nozzles 21 spray flush liquid on substantially all portions of the interior surface of the insert liner 12 below the plastic cover 19 and above the bottom section 16 thereof.

The socket 6 preferably mounts bowl 5 and body 2 so that they are rotatable about a substantially vertical axis for ease of installation, to allow proper positioning of the components thereof in areas where space is at a premium, such as in conventional vehicles in which the toilet unit 1 might be used (such as RVs, boats, caravans, trailers, and the like). Also rotation of the components 5, 2 with respect to the socket 6 may be maintained even after installation in situations where it is desirable—again because of space considerations—to rotate the bowl 5 forwardly during use, and then to the side when not in use.

The relative rotation between the socket 6 and the bowl 5 can be prevented or retarded, however, by the utilization of a locking mechanism, shown schematically at 22 in FIGS. 1 and 2. The locking mechanism 22 may comprise any conventional mechanism, such as a spring-biased clamp, which provides a clamping action between the seal 14 and the flange 13 which precludes relative movement. The spring force, or like force, provided by the biasing clamp of the locking mechanism 22 may be sufficient to preclude rotational movement between the parts 5, 6, completely, or merely be great enough to prevent any leakage and to hold the components 5, 6 into a relative position to which they have been moved, yet allow at least 90° of relative rotation between them. To accommodate this rotation, seals 23 may be mounted on the support surface 7 for the toilet unit 1 so as to allow rotation of the plastic body 2 with respect to the mounting surface 7. It is then necessary to provide a recess—shown only schematically at 2' in FIG. 2—for the pedal 24 to accommodate the relative rotation between the part 2 and the support 7 while allowing the pedal 24 to be in a relatively fixed position with respect to the vertical axis rotation of the body 2.

The pedal actuator 24 preferably substantially simultaneously actuates both the conventional flush liquid valve 25 and the spherical segment valve 9 for closing the outlet 8. That is upon pressing down on the pedal 24, the valve 25 is caused to be open causing flushing liquid to pass from the source 31 through the nozzles 21 into contact with the interior surface of the insert liner 12, while at the same time the valve segment 9 is rotated about a substantially horizontal axis to move to an open position allowing liquid and other materials within the toilet 5 to flow through the outlet 8 into a funnel-shaped outlet unit 26 mounted within the socket 6. The funnel-shaped outlet 26 is connected via a connecting piece 27 to one or more connecting channels 28, 28'. A number of different channels 28, 28', which pass through the wall of the socket 6, may be provided to facilitate easy mounting of the unit 1 in cramped locations, such as on vehicles. Any connecting channel 28, 28' not used is plugged.

The connecting channel 28 is illustrated in FIG. 1 connected up to a conventional vacuum source 29, and a conventional holding tank 30, such as used in the vacuum toilets sold by Sealand Technology Inc. of Big Prairie, Ohio, including under the "VACU-FLUSH" trademark, and/or such as illustrated in U.S. Pat. Nos. 3,663,970, 4,672,690, 5,408,704, 5,621,924, and/or 5,681,148. The vacuum source 29 and the holding tank 30 are mounted where convenient in the vehicle in which the toilet unit 1 is positioned. When a vacuum source 29 is used, the actuator pedal 24 also automatically connects the interior of the toilet bowl 5 to a vacuum tank or the like.

Figure 3:
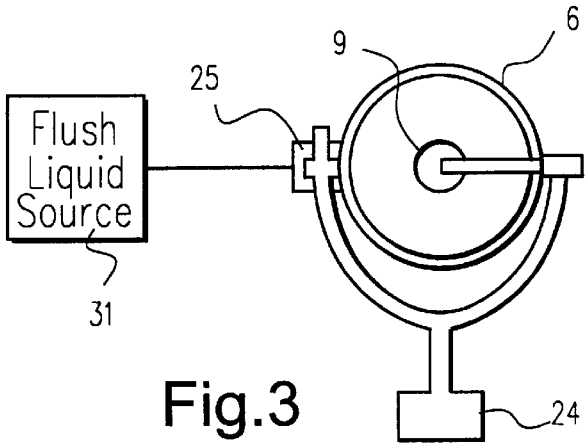
FIG. 3 is a schematic top view showing the common pedal actuator for the liquid flush valve, and the spherical segment valve for opening or closing the toilet bowl outlet, in the toilet unit of FIGS. 1 and 2.
Figure 4:
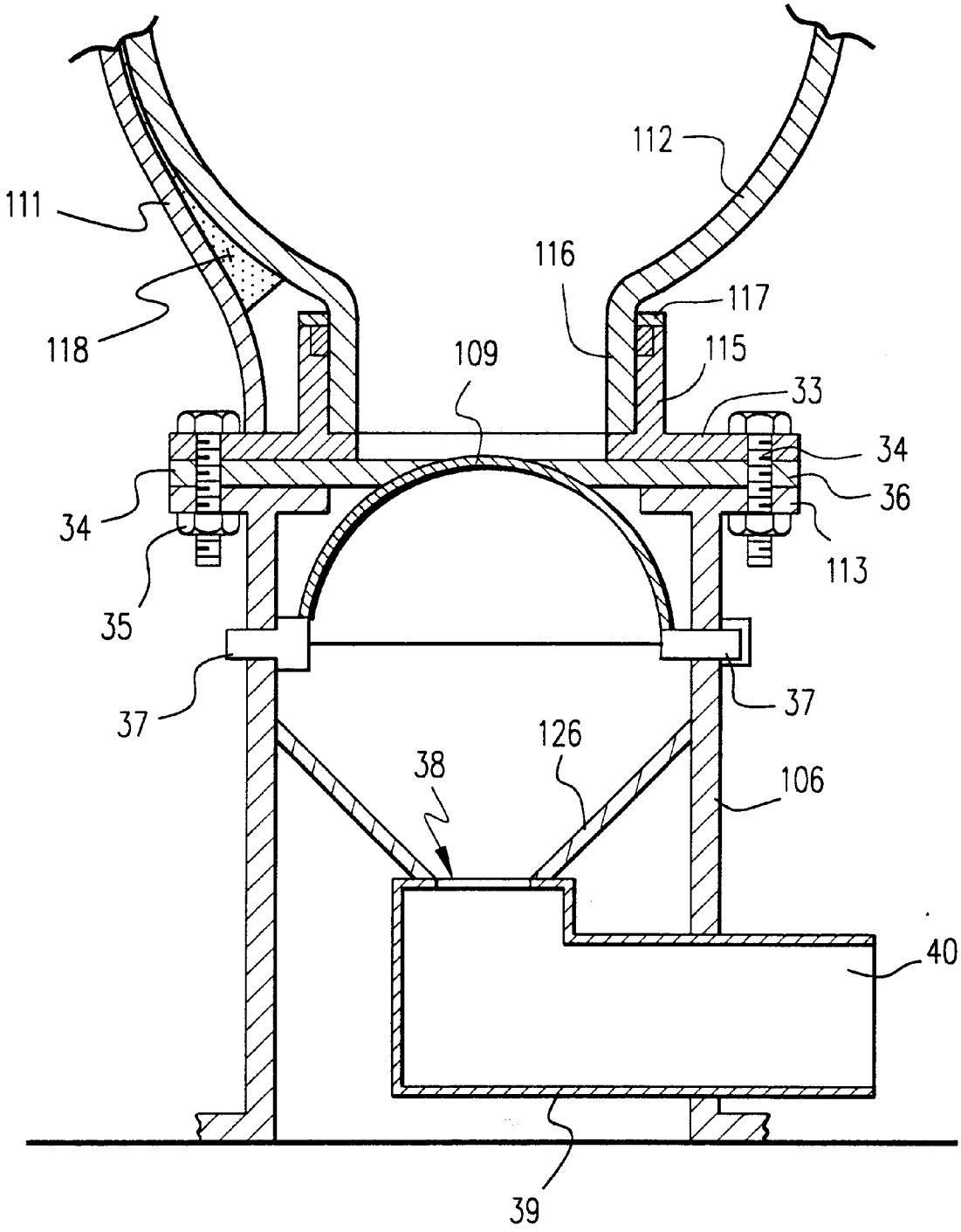
FIG. 4 is a side primarily cross-sectional view of an alternative construction of the base for the portable toilet according to the present invention.
Figure 5:
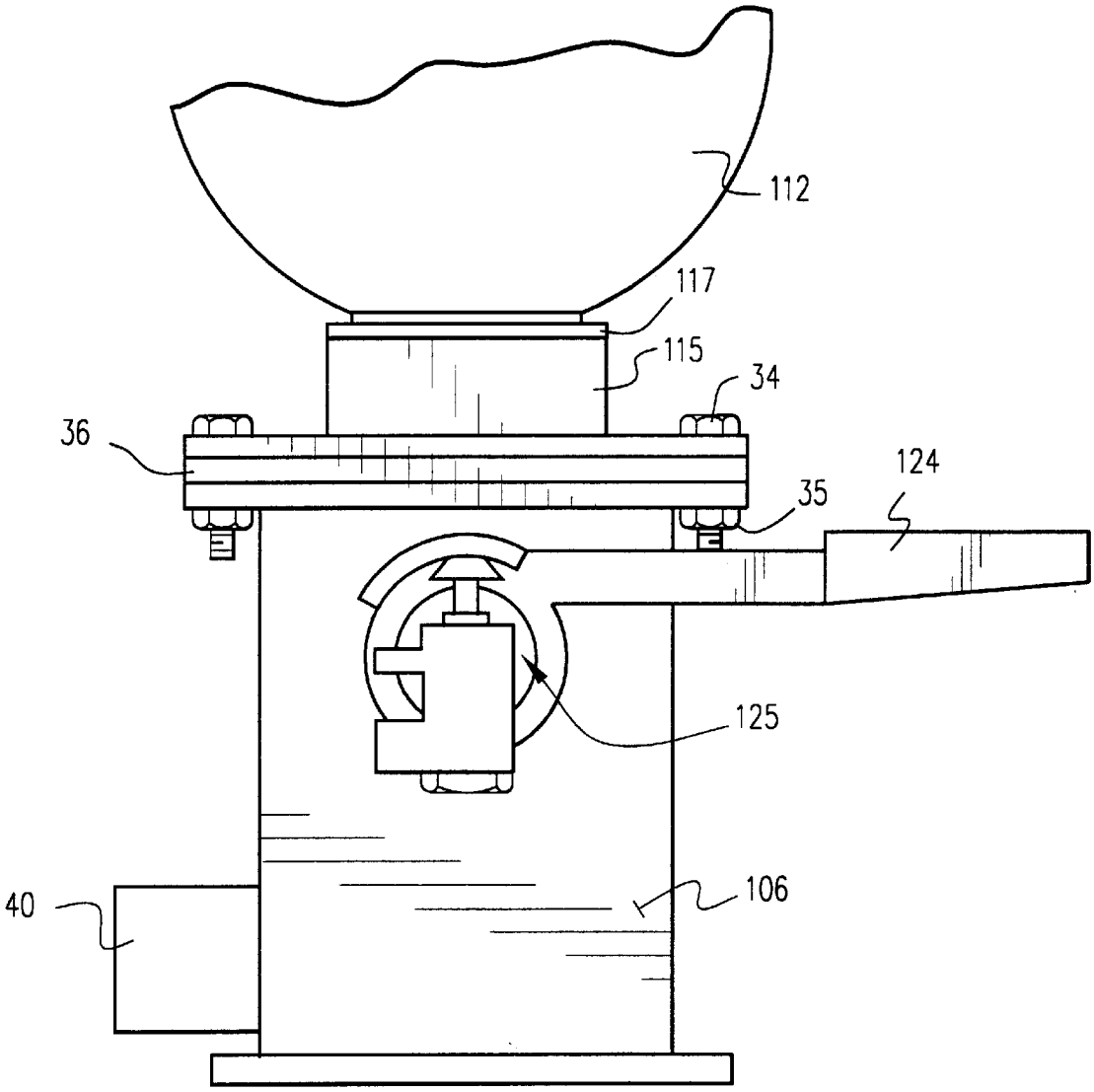
FIG. 5 is a side view of the base of FIG. 4 with a minor modification thereof.

In the FIGS. 4 and 5 embodiment, the base of the toilet unit is revised, providing a simplified pedestal arrangement. In the FIGS. 4 and 5 embodiment components functionally comparable to those in FIGS. 1–3 are shown by the same reference numeral plus 100. In FIG. 4 one version of part of the plastic toilet bowl 111 is shown on the left, but omitted on the right for clarity of illustration, and in FIG. 5 the elements 11, 12 have been removed completely. The upper portion of the toilet unit 101 is preferably substantially the same as that of the toilet unit 1. Other versions of the element 111 may also be provided, such as having a flange that is held in place by the bolts 34 with nuts 35.

In the FIGS. 4 and 5 embodiment the clamps 22 of FIGS. 1 and 2 have been replaced by the conventional plurality (e.g. four) of fasteners 34, 35, which compress the elastomeric seal 36 between the flanges 33, 113. The seal 36 also cooperates with the valve 109, which is mounted for pivotal movement about a substantially horizontal axis by the pivot pins 37.

The funnel shaped interior 126 of the socket 106 ends in an outlet opening 38 that extends completely into the larger diameter conduit 39. The discharge opening 40 of the conduit 39 is larger in cross-sectional area (e.g. has a larger diameter) than opening 38. The pedal actuator 124 is simpler than the actuator 24.

The FIG. 5 embodiment differs from that of FIG. 4 only in the position of the discharge outlet 40, the rear position of FIG. 5 being preferred to that of FIG. 4.

While the invention has been herein shown and described in what is presently conceived to be the most practical and preferred embodiment thereof, it will be apparent to those of ordinary skill in the art that many modifications may be made thereof within the scope of the invention. For example the material which provides enhanced longevity and hygiene that is disposed in association with the interior surface of the plastic toilet bowl 11 may be provided by a metal coating (e.g. galvanized) on plastic material, or by producing a compound material such as by casting plastic around a porcelain insert, or pressing an insert into a prefabricated carrier body. Also, in addition to adhesively connecting the insert 12 or like material to the interior surface of the plastic toilet bowl 11, or using the mounting foam 18, the insert 12 may simply be slipped into the toilet bowl 11 without a connection between them, or by providing spaced pressure and tension release components. Thus the invention is to be accorded the broadest interpretation of the appended claims so as to encompass all equivalent structures and devices.

What is claimed is:

1. A portable or mobile toilet unit comprising:

a plastic toilet bowl, having an interior surface, an open top, and an exterior surface;

a plastic body positioned exteriorly of said plastic toilet bowl exterior surface;

a plastic toilet seat for partially closing said open top of said plastic toilet bowl;

a non-polymeric, substantially poreless, thin-walled insert liner that is substantially not degraded as a result of contact with excrement, light, and toilet bowl cleaning agents, disposed interiorly of said plastic toilet bowl and for contacting liquid and materials passing through said toilet bowl open top, said insert liner having an outlet adjacent the bottom thereof for leading sewage away from said toilet bowl; and mounting foam between said plastic toilet bowl interior surface and said insert liner and providing noise dampening.

2. A toilet unit as recited in claim 1 wherein said insert liner comprises porcelain or glazed ceramic.

3. A toilet insert as recited in claim 2 wherein said mounting foam provides improved insert liner breaking strength.

4. A toilet unit as recited in claim 2 wherein said insert liner is about 0.3125 inches thick.

5. A toilet unit as recited in claim 2 mounted in a vehicle and connected to a vacuum source and holding tank.

6. A toilet unit as recited in claim 1 wherein said insert liner is replaceable, and said mounting foam comprises polyurethane.

7. A toilet unit as recited in claim 6 wherein said insert liner is replaceable and comprises porcelain, glazed ceramic, glass, corrosion resistant sheet metal, or sheet metal with a corrosion resistant poreless interior coating.

8. A toilet unit as recited in claim 1 wherein said insert liner comprises corrosion resistant sheet metal, or sheet metal with a corrosion-resistant substantially poreless interior coating.

9. A toilet unit as recited in claim 8 wherein said insert liner is about 0.05 inches thick.

10. A toilet unit as recited in claim 8 wherein said liquid flush mechanism includes a liquid flush valve; and further comprising a spherical segment valve for closing said outlet for leading sewage away from said toilet bowl; and a common foot pedal actuator for substantially simultaneously operating said liquid flush mechanism valve to introduce liquid into and through said insert, and to open said spherical segment valve to allow sewage to pass through said outlet.

11. A toilet unit as recited in claim 1 wherein said insert liner comprises glass.

12. A toilet unit as recited in claim 1 further comprising a liquid flush mechanism which flushes liquid into and through said insert liner.

13. A toilet unit as recited in claim 12 wherein said toilet bowl includes an upper edge; and wherein said liquid flush mechanism includes a plurality of nozzles positioned adjacent said upper edge of said toilet bowl, and connected to a source of flushing liquid.

14. A toilet unit as recited in claim 12 further comprising a spherical segment valve body for selectively closing said outlet for leading sewage away from said toilet bowl.

15. A toilet unit as recited in claim 1 further comprising a lip seal which seals a bottom cylindrical section of said insert liner to said plastic toilet bowl adjacent said outlet.

16. A toilet unit as recited in claim 1 wherein said plastic body includes an annular plastic cover adjacent said toilet seat, and wherein said insert liner has an upper rim received by said annular plastic cover.

17. A toilet unit as recited in claim 16 wherein said plastic toilet bowl has a radially extending portion thereof extending radially outwardly from said insert liner, said radially extending portion thereof forming a circumferential seat for said plastic cover.

18. A toilet unit as recited in claim 16 wherein said toilet bowl includes an upper edge; and wherein said liquid flush mechanism includes a plurality of nozzles positioned adjacent the upper edge of said toilet bowl, and connected to a source of flushing liquid.

19. A toilet unit as recited in claim 18 wherein said nozzles are disposed in said plastic cover and mounted separately from said insert liner.

20. A toilet unit as recited in claim 1 wherein said plastic body and toilet bowl are supported by a socket for rotation about a substantially vertical axis.

21. A toilet unit as recited in claim 20 further comprising a locking mechanism which allows said toilet bowl to be locked with respect to said socket so as to prevent relative rotation therebetween.

22. A toilet unit as recited in claim 21 wherein said outlet is selectively closable by a spherical segment valve body, and wherein said valve body is supported by said socket for rotation about a substantially horizontal axis.

23. A toilet unit as recited in claim 20 further comprising a funnel-shaped structure disposed within said socket for transporting sewage from said outlet to a connecting channel extending through said socket.

24. A portable or mobile toilet unit comprising:

a plastic toilet bowl, having an interior surface, an open top, and an exterior surface;

a plastic body positioned exteriorly of said plastic toilet bowl exterior surface;

a plastic toilet seat for partially closing said open top of said plastic toilet bowl;

a non-polymeric, substantially poreless, a thin-walled insert liner which is disposed within and is at least partially supported by said interior surface of said plastic toilet bowl, and that is substantially not degraded as a result of contact with excrement, light, and toilet bowl cleaning agents, disposed interiorly of said plastic toilet bowl and for contacting liquid and materials passing through said toilet bowl open top, said insert liner having an outlet adjacent the bottom thereof for leading sewage away from said toilet bowl; and a lip seal which seals a bottom cylindrical section of said insert liner to said plastic toilet bowl adjacent said outlet.

* * * * *